United States Patent [19]

Clement

[11] 4,296,563

[45] Oct. 27, 1981

[54] DISPLAY DEVICE WITH PRICE CHANGE CARTRIDGES

[75] Inventor: Joseph Clement, Bradenton, Fla.

[73] Assignee: The Mead Corporation, Dayton, Ohio

[21] Appl. No.: 175,476

[22] Filed: Aug. 5, 1980

[51] Int. Cl.[3] ..... G09F 11/18

[52] U.S. Cl. ..... 40/518; 40/5

[58] Field of Search ..... 40/1, 5, 518, 10 R, 40/16 R, 576

[56] References Cited

U.S. PATENT DOCUMENTS

| | | | |
|---|---|---|---|
| 1,518,063 | 12/1924 | Gottfried | 40/5 |
| 2,585,420 | 2/1952 | Ailes | 40/5 X |
| 3,014,294 | 12/1961 | Singer | 40/5 |
| 3,016,638 | 1/1962 | Singer | 40/5 |
| 3,159,937 | 12/1964 | Barnes | 40/5 X |
| 3,660,918 | 5/1972 | Bourseau | 40/575 |
| 3,939,584 | 2/1975 | Trame | 40/576 |
| 4,177,588 | 3/1981 | Gebhardt | 40/518 |
| 4,258,490 | 3/1981 | Trame | 40/16 X |

*Primary Examiner*—Hugh R. Chamblee
*Assistant Examiner*—Wenceslao J. Contreras
*Attorney, Agent, or Firm*—Erwin Doerr

[57] ABSTRACT

A display device such as is used to display information relating to the description and price of goods for sale comprises a translucent facia panel (12) providing the front face of a display cabinet behind which is mounted one or more cartridges (16,17) each carrying self-coiling information strips (27,28,29) readily adjustable so that the information regarding the goods may be quickly and easily changed, the cartridges being mounted on mounting panels (24) spaced from the facia (12) so that the cartridges (16,17) are located within the space between the mounting panels and the facia of the cabinet.

7 Claims, 3 Drawing Figures

DISPLAY DEVICE WITH PRICE CHANGE CARTRIDGES

This invention relates to a display device of the type disclosed in my co-pending patent application Ser. No. 095,970 filed on Nov. 20, 1979, now U.S. Pat. No. 4,262,436, and incorporated herein by reference. The device comprises a facia on which information regarding the goods offered for sale is presented together with price indicia such that the attention of a prospective customer is attracted.

Known are devices wherein the price and/or other information regarding products are carried on self-coiling plastics information strips. Examples of the prior art are found in U.S. Pat. No. 3,159,937 to Barnes and U.S. Pat. No. 3,939,584 to Trame. Such known devices, however, have the disadvantage that the supports or carriers on which the information strips are held are not immediately detachable from behind the facia, so making the replacement of the information strips a tedious and time consuming operation. A further drawback of known constructions is that the basic format of the display device cannot be readily altered.

The display device of the present invention overcomes both the above disadvantages by providing immediately removable information strip cartridges and by providing an assembly in which the format of the facia can be altered readily.

One aspect of the present invention provides a display device comprising at least one information strip, each strip having thereon a series of characters, a carrier including a display area on which carrier said strip is mounted for slidable adjustment with respect thereto whereby the characters can be sequentially displayed in said display area, support means on which said carrier detachably is mounted with the display area located remote from the support means, and a translucent facia provided adjacent the display area of said carrier through which each character presented in the display area can be viewed, said facia and support means together defining a space in which said carrier is accommodated.

Another aspect of the present invention provides a display device comprising at least one information strip, each strip having thereon a series of characters and being mounted on a carrier for slidable adjustment with respect thereto, whereby the characters can be sequentially displayed on the carrier, and a facia formed by a continuous translucent panel having a front face and a back face, and wherein said carrier detachably is mounted adjacent the back face of said facia such that characters displayed on the carrier can be viewed through the front face of said facia.

The invention is described in more detail in the following description taken in conjunction with the accompanying drawings, set forth by way of illustration only, in which.

Figure 1:
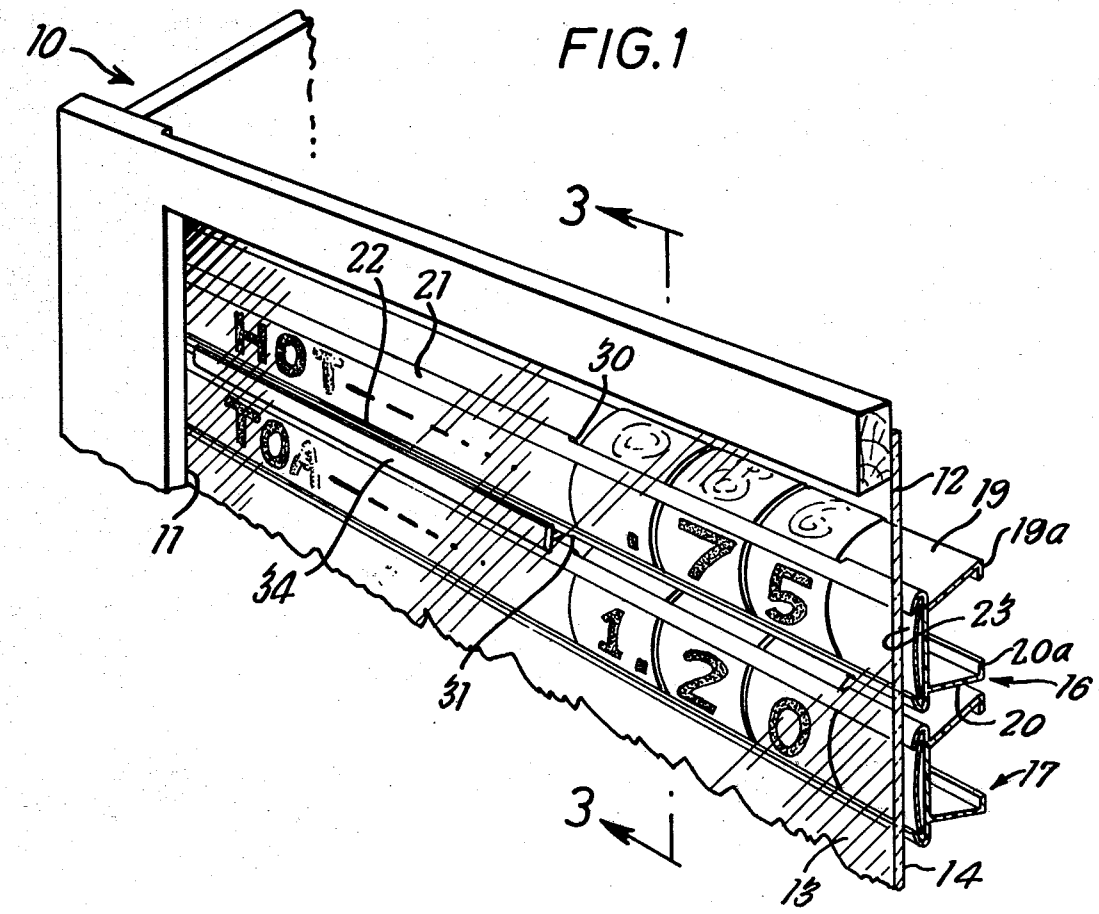
FIG. 1 is a perspective front view of a part of a display cabinet according to the invention.

Referring to the drawings, there is shown in FIG. 1 the front portion of a display cabinet generally designated by the reference numeral 10. The front face of the display cabinet 10 includes a rectangular opening 11 in which is mounted an elongate facia comprising a panel 12 formed from a translucent material such as clear acrylic or other plastics. The panel has an uninterrupted front surface 13, that is to say there are no apertures formed in the panel. Hence information to be presented for viewing through the facia panel 12 is attached adjacent the rear surface 14 of the facia and is viewed through the translucent material. The facia panel 12 is attached to the front wall of cabinet 10 by means of suitable fasteners 15 (FIG. 2) thereby providing a front window of the display cabinet.

The information to be displayed by the cabinet is carried on information strips supported by cartridges such as the cartridges designated by reference numerals 16, 17. For the sake of convenience, a detailed description will be made only in respect of the cartridge 16, it being understood that cartridge 17 is similar in all respects.

Figure 2:
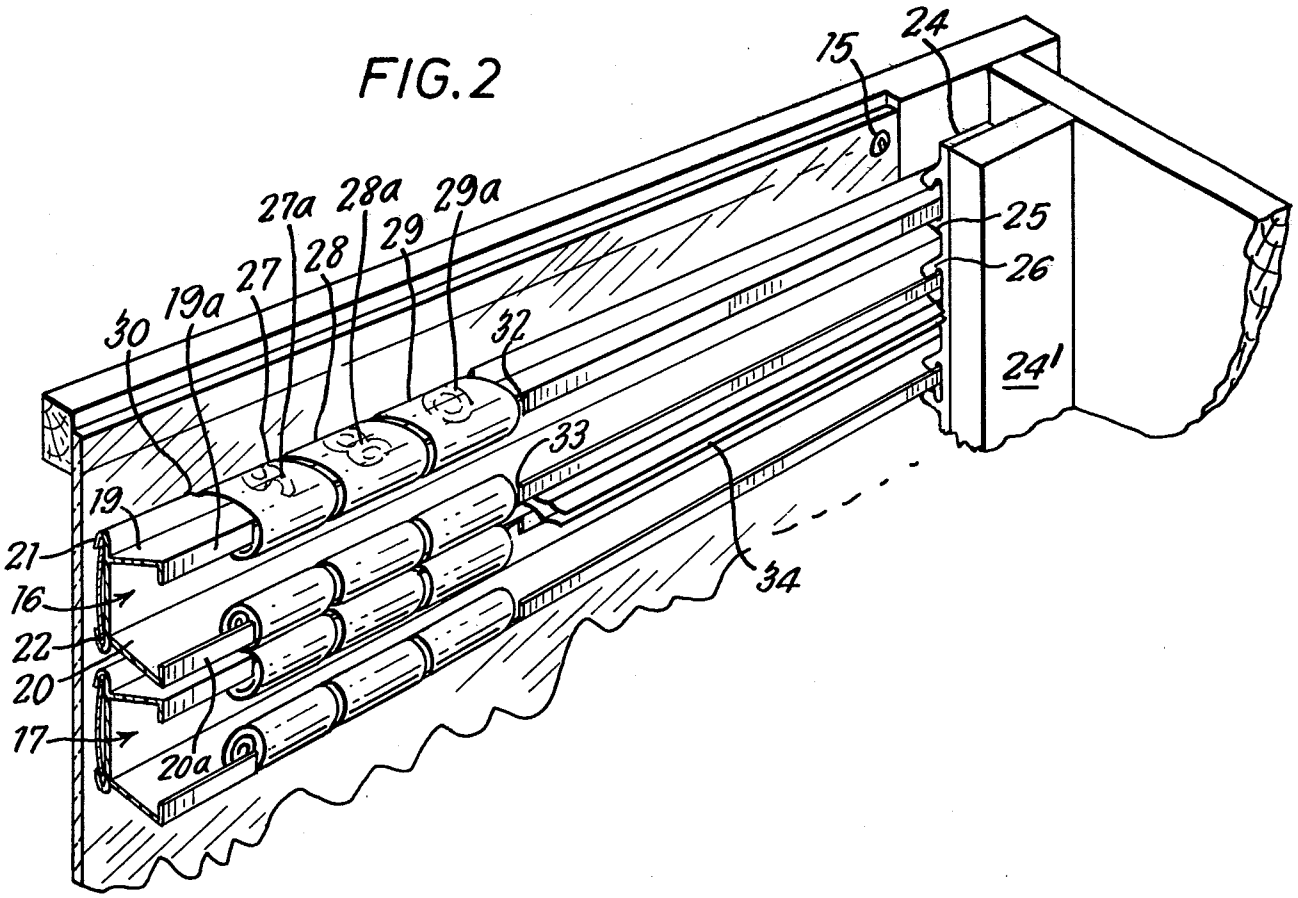
FIG. 2 is a perspective rear view of the cabinet illustrated in FIG. 1.
Figure 3:
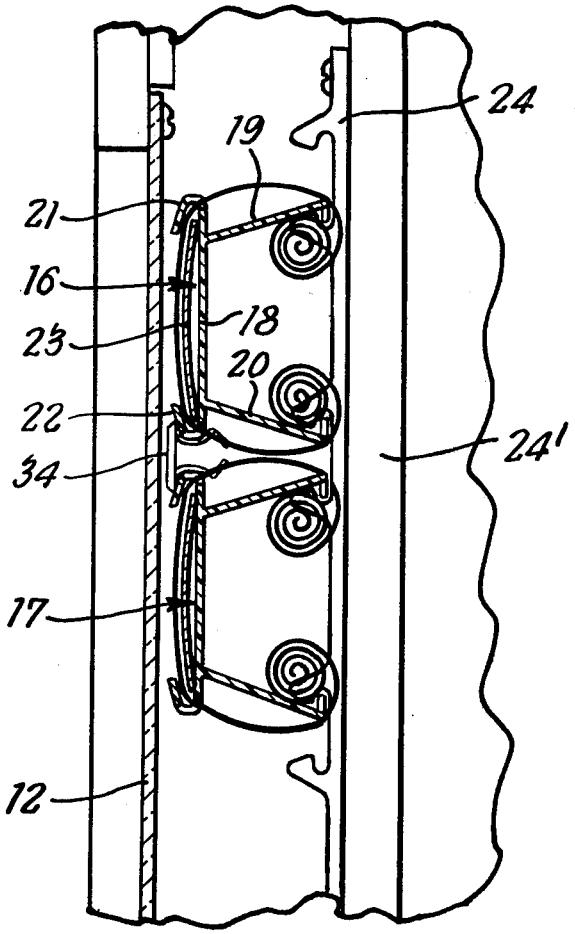
FIG. 3 is a cross-sectional view taken along the line 3-3 in FIG. 1 of the drawings.

The cartridge 16 illustrated in FIGS. 1 to 3 of the drawings comprises an elongate plastics carrier of generally channel shaped cross-section. The base of the channel section provides a support wall 18 from which extend a pair of divergent side walls 19, 20 terminating in juxtaposed flanges **19*a*, 20*a* respectively. The support wall 18 is extended in both lateral directions beyond each of the side walls 19, 20 and terminate in a pair of integral, forwardly facing lips 21, 22. The lips 21, 22 extend outwardly from support wall 18 in the opposite direction to that of the side walls 19, 20 and thereby overlap edge portions of the front face of the support wall 18. The purpose of lips 21, 22 is to retain card inserts e.g. insert 23 adjacent the facia 12 of the display device 10. The insert 23 is formed from paperboard or other suitable printable material such as plastics and is mounted by being slid into the groove provided by the lips 21, 22 and the support wall 18 of the cartridge 16. The face of the insert 23 adjacent the rear surface 14 of the facia 12 is provided with information e.g. a description of the goods to be sold, such as that shown by the numeral 23*a* which can be viewed from the front of the facia 12 as illustrated in FIG. 1. It will be apparent that a number of inserts may present a variety of information which can be located on the cartridge 16 thus making for a readily changeable display format. Moreover, it is envisaged that the cartridge could, of course, be displayed without the use of inserts. In this event, the display could be constituted solely by the information presented by the cartridges or alternatively the facia panel 12** itself could be printed or otherwise marked with information to be displayed.

To mount the cartridge 16 within the display cabinet a pair of support panels (only one panel 24 of which is shown) is provided at opposite ends of the cabinet adjacent the front facia 12. Each panel 24 mounted on inwardly projecting cabinet walls as at 24' and is provided with integral rail pairs such as those shown at 25, 26, which are spaced apart to cooperate with the juxtaposed flanges **19*a*, 20*a* respectively of the cartridge 16. Hence the cartridge 16 is mounted within the space defined between the facia 12 and the support panels 24 adjacent the rear surface 14 of the facia such that the flanges 19*a*, 20*a* are connected to the rails 25, 26 carried by the support panels 24. This connection may be a resilient attachment achieved by pushing the cartridge 16 on to the support panels 24 so that the flanges 19*a*, 20*a* are forced resiliently into abutment with the rails 25, 26 thereby providing a "snap-on" connection, or alternatively by sliding the cartridge 16 on to the support panels 24 so that the flanges 19***a*, 20*a* are located between the rails 25, 26. In either case a push-pull attachment exists whereby the cartridge is immediately attachable to and detachable from the support panels 24. It is envisaged that the cabinet could be illuminated internally, in which case if the cartridges were to comprise a translucent material then light would be transmitted through the translucent parts of the cartridge to enhance the display.

The cartridge 16 supports three self-coiling information strips 27, 28 and 29 (FIG. 2) in side-by-side relationship each of which strips are made from a material having a tendency to form coils at its opposite ends when unrestrained. Such a material is known in the art, e.g. the heat treated polyethelene terephtalate disclosed in U.S. Pat. No. 3,426,115 (Taber) which is a material having the tendency to form coils at opposite ends when unrestrained. One such material is sold under the registered trade mark "Spring Roll." However, it is envisaged that the information strips could comprise endless belts or alternatively tapes rolled on to a pair of spools. The strips 27, 28, 29 are each provided with a series of indicia or other information generally referred to by the term "characters" as at 27*a*,28*a*,29*a* respectively and are mounted on the cartridge so as to be slidably adjustable. The opposite coiled ends of each self-coiling strips 27, 28, 29 are accommodated in the 'U' shaped cavity defined by the rear face of the support wall 18 and the two side walls 19, 20 so that an uncoiled portion of each strip between its coiled ends passes across the front face of the support wall 18 of the carrier 16. The self coiling strips can be adjusted so that the characters are sequentially displayed in the non-coiled section adjacent the front face of the support wall 18 merely by applying finger pressure and moving the strip in a manner tending to transfer a length of the strip from one coiled end to the other.

In order to prevent the end of a strip becoming dislodged from the carrier during adjustment it is envisaged that a portion of the strip adjacent each of its ends is struck out to form a curled tab (not shown). Such a tab would catch on one of the flanges 19*a*, 20*a* to prevent the end of the strip leaving the 'U'-cavity.

The forward facing lips 19, 20 are each formed with an elongate slot defined by a cut out portion of the lip as at 30 and 31 and similarly the flanges 19*a*, 20*a* are formed with cut out portions 32, 33 respectively (FIG. 2). Uncoiled portions of strips 27, 28, 29 pass through in these slots and recesses to provide correct mounting of the strips and to prevent lengthways movement of the strips with respect to the cartridges. It is envisaged that the cartridge may have more or less information strips than those illustrated depending on the display desired.

In constructions where it is desired to provide internal illumination within the cabinet the information strips 27, 28, 29 themselves also may be formed at least partially from a translucent material. Thus, either the characters 27*a*, 28*a*, 29*a* may be translucent so that light may be transmitted through the characters with the surrounding areas of the information strips opaque or alternatively the surrounding areas may be translucent with the characters 27*a*, 28*a*, 29*a* opaque. It will be appreciated that a number of cartridges can be mounted within the display cabinet 10 in side-by-side relationship. An example of this arrangement is, of course, shown in the drawings by the mounting positions of the cartridges 16 and 17. However, several further cartridges may be provided within the display cabinet in which case the appropriate number of mounting rails would be provided on support panels 24. In this type of multi-cartridge construction the forward facing parts of the cartridges are unsupported and it may be desirable to provide for correct spacing between adjacent cartridges along these unsupported areas. Hence, it is envisaged that a spacing clip such as that designated reference number 34 may be snapped in between the front lips of adjacent cartridges within the display cabinet to hold the cartridges apart.

I claim:

1. In a display device of the type comprising a translucent facia, a carrier disposed behind said facia and including a display area, at least one information strip bearing a series of characters and being mounted on said carrier for slidable adjustment so that the characters can be sequentially displayed in said display area, support means on which said carrier is detachably mounted with the display area located adjacent said facia, said facia and support means together defining a space in which said carrier is accommodated, the improvement wherein said support means comprises panels located adjacent opposite ends of said facia and complementary attachment means provided on said carrier and on said support means, said complementary means comprising rails provided on said panels and flanges provided on said carrier.

2. A display device according to claim 1 in which each information strip is a self-coiling tape.

3. A display device according to claim 1 in which said carrier is formed from a translucent plastics material.

4. A display device according to claim 2 in which said carrier comprises an elongate cartridge including a front surface providing said display area on which an uncoiled portion of each self-coiling strip is supported, a pair of spaced side walls co-extensive with said cartridge and extending from the back face of said display area, said legs each terminating in an elongate flange for detachably mounting the cartridge on said support means and together defining a storage cavity in which the coiled ends of each strip are accommodated.

5. A display device according to claim 4 in which retaining means are provided on said front surface for retaining an insert having a surface for displaying information observable through said facia, said retaining means comprising a pair of elongate lips extending along the cartridge from said front face to slidably receive said insert, and wherein said lips include openings through which said uncoiled portions of each information strip pass from the display area to the storage cavity.

6. A display device according to claim 1 in which said support means comprises a series of rail pairs whereby a plurality of said carriers are connected thereto in side-by-side relationship.

7. A display device according to claim 1 in which said device is a cabinet having its front face provided by said translucent facia, said support means being mounted internally of the cabinet with said carrier connected to said support means and located in a space formed between said facia and said support means.

* * * * *